US006715380B2

(12) United States Patent
Listl et al.

(10) Patent No.: US 6,715,380 B2
(45) Date of Patent: Apr. 6, 2004

(54) POWER-DRIVEN SCREWDRIVER

(75) Inventors: Holger Listl, Leinfelden-Echterdingen (DE); Klaus Schmitz, Reutlingen (DE)

(73) Assignee: C. & E. Fein GmbH & Co. KG (DE)

( * ) Notice: Subject to any disclaimer, the term of this patent is extended or adjusted under 35 U.S.C. 154(b) by 135 days.

(21) Appl. No.: 10/145,279

(22) Filed: May 14, 2002

(65) Prior Publication Data

US 2003/0010158 A1 Jan. 16, 2003

(30) Foreign Application Priority Data

May 14, 2001 (DE) ..... 101 24 569
May 14, 2001 (DE) ..... 101 24 571
May 14, 2001 (DE) ..... 101 24 572
May 14, 2001 (DE) ..... 101 24 573

(51) Int. Cl.[7] ..... B25B 21/00
(52) U.S. Cl. ..... 81/57.13; 81/57.29
(58) Field of Search ..... 81/57.13, 57.29, 81/63, 62; 192/43.1; 173/12; 475/153

(56) References Cited

U.S. PATENT DOCUMENTS

| | | | | |
|---|---|---|---|---|
| 3,277,670 A | | 10/1966 | Bent | 64/29 |
| 3,792,737 A | | 2/1974 | Bratt | 173/12 |
| 4,215,594 A | | 8/1980 | Workman, Jr. et al. | 74/751 |
| 4,346,765 A | | 8/1982 | Workman, Jr. | 173/12 |
| 4,411,173 A | * | 10/1983 | Mixer | 60/695 |
| 4,427,077 A | * | 1/1984 | Hall | 173/183 |
| 4,535,850 A | * | 8/1985 | Alexander | 173/176 |
| 5,385,512 A | | 1/1995 | Moolenaar et al. | 475/153 |
| 5,577,425 A | * | 11/1996 | Holmin et al. | 81/57.39 |
| 6,568,298 B1 | * | 5/2003 | Zinck | 81/57.13 |
| 2001/0027871 A1 | * | 10/2001 | Tokunaga | 173/93 |
| 2003/0010158 A1 | * | 1/2003 | Listl et al. | 81/57.13 |

FOREIGN PATENT DOCUMENTS

| | | |
|---|---|---|
| DE | 683 190 | 11/1939 |
| DE | 1 403 393 | 11/1970 |
| DE | 3432376 | 3/1986 |
| DE | 40 38 226 | 6/1992 |
| DE | 41 23 349 | 3/1993 |
| DE | 43 33 599 | 4/1994 |
| DE | 43 44 849 | 7/1995 |
| DE | 197 19 736 | 11/1997 |
| DE | 198 45 018 | 12/1999 |
| DE | 198 33 943 | 2/2000 |
| DE | 39 19 648 | 12/2000 |
| EP | 0 691 185 | 1/1996 |
| WO | WO 99/16585 | 4/1999 |
| WO | WO 99/16858 | 4/1999 |

* cited by examiner

*Primary Examiner*—Lee D. Wilson
(74) *Attorney, Agent, or Firm*—St. Onge Steward Johnston & Reens LLC

(57) ABSTRACT

An angle type power screwdriver having a housing comprising a main housing is disclosed, within which a drive, a reduction gear coupled therewith and a spindle driven thereby are received. An angle head comprising a tool spindle arranged at an angle to the spindle and driven thereby for driving a tool comprises an angle head housing that is connected to the main housing via an adjusting device angularly adjustable. The reduction gear comprises a reaction part receiving a reaction moment with respect to the spindle, the angle head housing being connected with the reaction part for common rotation therewith and being coupled to the drive via the adjusting device.

47 Claims, 8 Drawing Sheets

POWER-DRIVEN SCREWDRIVER

This application claims priority of pending German Patent Application Nos. 101 24 569.6, 101 24 571.8, 101 24 572.6 and 101 24 573.4 all filed on May 14, 2001.

BACKGROUND OF THE INVENTION

The invention relates to a power-driven screw drive comprising a housing having a main housing within which a drive, a reduction gear coupled therewith and a spindle received therein are supported, further comprising an angle head having a tool spindle for driving a tool, the tool spindle driven by the spindle and arranged at an angle thereto, and further comprising an angle head housing that is connected adjustably with the main housing via an adjusting device.

Such a screw drive is known from EP 0 691 185 A1.

From WO 99/16858, a power screwdriver having a torque limiting coupling releasing torque-dependently is known comprising a first coupling part, a second coupling part, a spring element for axially biasing both coupling parts against each other, and further having at least one roll body rolling between both coupling parts, the at least one roll body coupling both coupling parts when driving the screwdriver up to a preset release moment, when tightening a screw.

Angle-type screwdrivers having an adjustable angle head within which a tool spindle for driving a tool is received at an angle to a spindle driven by a gear, have several advantages with respect to other power-driven screwdrivers the tool receptacle of which is received directly on the spindle and which are thus oriented in the longitudinal direction of the screwdriver. On the one hand, the possibility for adjusting the tool head allows different operating positions, allowing in many cases a more economic operation, even under confined conditions. On the other hand, the reaction moment received by the screwdriver during tightening and loosening of screws does not lead to a turning of the screwdriver about its longitudinal axis, but to a pivoting of the screwdriver about the angle head. Such pivot movements can be controlled by the operator much easier than a rotation of the screwdriver about its longitudinal axis.

The angle-type screwdriver known from EP 0 691 185 A1 mentioned at the outset, comprises a rotatable angle head which is connected to a main housing of the angle-type screwdriver by a screw connection. Within the main housing, a drive and a reduction gear of the angle-type screwdriver are supported fixedly against rotation. The screw connection is arranged directly at the transition from the angle head to the main housing and is secured by a securing nut against unintentional rotation. When operating the angle-type screwdriver between the angle head and the main housing part, relatively large torques may occur. Therefore, there is an additional retention against rotation by providing a locking pin. In a locking position, the locking pin extends through bores within which the angle head and the main housing extend in radial direction in the region of the screw connection. In this way, the angle head can be locked fixedly against rotation with respect to the main housing in several positions, so that the angle head cannot change its position unintentionally when operating the angle-type screwdriver.

SUMMARY OF THE INVENTION

It is a first object of the invention to provide an improved angle-type screwdriver allowing for a relative rotation between the angle head and the main housing a particularly simple and cost-effective way.

It is a second object of the invention to allow an easy adjustment of the angle head with respect to the housing even during operation of the angle-type screwdriver.

It is a third object of the invention to provide an angle-type screwdriver having a torque limiting coupling having high reliability and low wear during operation.

It is another object of the invention to provide a power screwdriver allowing for a precise adjusting for the tightening torque of a screw.

It is still a further object of the invention to provide a power screwdriver of high reliability having a torque limiting coupling with low wear in operation.

These and other objects are solved by the invention by the fact that the reduction gear comprises a reaction part receiving a reaction moment with respect to the spindle, the reaction part being connected with the angle head housing fixedly against rotation and being coupled to the drive adjustably.

The reduction gear may be any gear suitable for transmitting torque from an input end to an end and having a transmission ratio of less than one, which means that there will be a lower output than input speed. A reduction gear will transmit a higher torque at its output end than it receives at its input end. The reaction torque resulting therefrom is received by a part which is called reaction part and which must be somehow supported externally. If the reaction part would not be supported externally, than the reaction part would freely rotate, when the input end is driven. Thus the reduction gear would not transmit the desired torque at its output end.

The reduction gear could for instance be a spur gear received within a gear housing, the gear housing forming the reaction part. Or the reduction gear may be a planetary gear comprising a hollow wheel within which planetary wheels and at least one sun wheel are received. The hollow wheel would then form the reaction part. Also any other type of gear can be used.

According to the invention, the connection of the reaction part with the angle head housing in a way fixedly against rotation while also coupling to the drive via an adjustment means leads to the consequence that the reaction part is connected to the angle head housing fixedly against rotation even when the adjustment device is completely released and thus the angle head can be rotated with respect to the main housing. By contrast, in prior art angle-type screwdrivers, the reaction part is always directly connected with the drive or with a housing part fixed thereto, without any adjustment possibility. The different connection of the reaction part with the two parts of the angle-type screwdriver that are adjustable thereto has important implications with respect to the torques that act between the angle head housing and the main housing and which must be absorbed by the adjusting device in operation.

For illustration, it may be assumed that the spindle is blocked by a screw that has been fully tightened so that the torque exerted by the drive must be fully absorbed between the housing parts of the angle-type grinder. In this case, the torque exerted by the drive operates between the drive and the reduction gear, on the one hand by a spindle section lying therebetween, and on the other hand, as a counter torque, between the housing parts which are connected with the reaction part of the reduction gear and with the drive, respectively. This torque is reduced by the reducing factor of the reduction gear with respect to the torque that acts between the reduction gear and the angle head. Thereby, the adjustment device can be constructed much simpler and not as sturdy as the adjustment devices necessary in prior art designs which allow an adjustable connection between the reaction part of the reduction gear and the angle head housing.

Due to the small torque that must be absorbed by the adjustment device, it is even possible to adjust the angle head during operation of the angle-type screwdriver or when the screw is fully tightened or blocked.

Any locking nuts or additional locking mechanisms become superfluous in this way. By contrast, it is sufficient to design the adjustment device as a simple screw connection. Alternatively, or in addition thereto, it is of course possible, to provide a locking mechanism, for instance if pre-defined relative positions between the angle head and the main housing are desired. However, such a locking mechanism is not necessary in view of the torque to be transmitted. However, if such a locking mechanism is desired, the mechanism may be very simple and light, since it must not absorb any considerable torque.

Of course, corresponding considerations are valid also with respect to angle-type screwdrivers in which the reaction part of the reduction gear is not supported directly by the angle head housing, but in which a torque limiting coupling is arranged therebetween.

Therefore, according to an advantageous development of the invention, the angle-type screwdriver comprises a torque limiting coupling having a first and a second coupling part, which engage with each other when the torque limiting coupling is engaged, thereby connecting the first coupling part with the angle head housing fixedly against rotation and to the drive via the adjustment means, the second coupling part being connected with the reaction part of the reduction gear fixedly against rotation.

When compared with torque limiting couplings that are arranged directly between two sections of a drive train, this design offers the advantage that there is no relative rotation between both coupling parts when the torque limiting coupling is engaged. Thereby, the coupling parts and any roll bodies arranged therebetween are not subjected to any large centrifugal forces that would lead to an increased wear. Since for the releasing of the torque limiting coupling both coupling parts must be withdrawn from each other, possibly against the power of a compression spring, the first or the second coupling part may be arranged axially slidable within the housing. To allow a relative rotation between both coupling parts, also one of these parts must be arranged rotatably within the housing.

According to a further development of this embodiment, the first coupling part is arranged within the housing axially slidable, and the reaction part is arranged freely rotatable with respect to the housing.

In this way, the possibilities of axial sliding and of rotation are assigned to different coupling parts, whereby the fixation to the housing of the angle-type grinder is simplified.

Also it is preferred to provide a switch for switching off the angle-type grinder, the switch being actuable by the first coupling part.

In this way, it is prevented that the drive continues to exert power onto the coupling parts, when the torque limiting coupling was released. Thus a continued revolution of the roll bodies between both coupling parts is avoided.

Also it is preferred, when the reaction part is configured as a hollow wheel comprising several planetary wheels of a planetary gear.

According to an alternative embodiment of the invention, on both coupling parts catches are provided for locking both coupling parts directly when driving the screwdriver in a second direction of rotation (loosening direction).

Since both coupling parts are directly locked with each other when a screw is released, very high torques can be transmitted between both coupling parts, in particular without utilizing the roll bodies between the coupling parts. Since the roll bodies do not have to transmit the torque when releasing or unscrewing a screw, the roll bodies are subject to considerably less wear than usually occurred in prior art torque limiting couplings. Also any cams, teeth, protrusions or steps which are engaged by the roll bodies, when the torque limiting coupling is engaged, are subject to the same advantages. By the way, under the term "locking", any positive engagement between the two coupling parts shall be understood. Preferably, a positive fit of the catches between the coupling parts is effected in a two-dimensional way, so that also larger torques can be transmitted between the two coupling parts without any deformation.

Thus by the direct locking of both coupling parts, explicitly no provision is made for a torque dependent disengagement of the torque limiting coupling, when a screw is released or untightened. However, the lack of such a possibility for disengagement can be tolerated under safety considerations. Anyway, if such a torque dependent disengagement should be desired when releasing or untightening screws, then, for instance, a second torque limiting coupling could be included in the drive train which releases only at a higher torque when operated in reverse direction.

According to an alternative embodiment of the invention, the torque limiting coupling is coupled with the spindle by a loose coupling.

Thereby, it is ensured that the preset release moment is obtained exactly. According to the invention, it was found that any unprecise disengagement in prior art designs is due to the effect of the torque limiting coupling. In particular, when the torque limiting coupling is released after tightening a screw, then the torque limiting coupling effects a torque acting in the counter direction (loosening direction), i.e. the screw, after having reached the release moment is loosened again to a small extent. Since the magnitude of the torque acting in the loosening direction is not known, the actual tightening moment that was effected on the screw cannot be predicted exactly in the prior art designs.

In these designs the torque acting in the loosening direction when the torque limiting coupling releases, results from the fact that the pressure spring acting between both coupling parts continues to exert pressure, even after both parts have moved apart when the torque limiting coupling releases. This pressure then also acts via the roll bodies onto the other coupling part. This torque acting on the other coupling part causes a loosening moment affected on the spindle, thus leading to a loosening of the screw to be tightened.

According to the invention, a loose coupling between the torque limiting coupling and the spindle avoids that such a loosening moment might be transferred from the torque limiting coupling onto the spindle, since the loose coupling releases on its own when the direction of rotation is reversed.

The considerations explained before also hold true with respect to torque limiting couplings of different designs, for instance also with respect to torque limiting couplings integrated in a drive train and acting onto the spindle without any gear. Since torque limiting couplings for screwdrivers always include two coupling parts biased against each other, when the torque limiting coupling engages again after a release operation, a relative movement between the two coupling parts is always effected, thus leading to a loosening moment acting onto the spindle. Consequently, the concept of the loose coupling can also be applied advantageously to any other kind of power screwdriver, e.g. to a screwdriver of straight configuration, to avoid any loosening reverse moment when the torque limiting coupling releases.

According to a further embodiment of the invention, the roll bodies are configured as rolls.

Thereby, any point contact that usually occurs in prior art designs when using balls as roll bodies, is substituted by a linear contact. Thus, the forces acting on the roll bodies are distributed onto larger surfaces, whereby any wear of the roll bodies itself as well as any wear of the respective guide faces, by which the roll bodies are guided, are decreased considerably. Thereby, the design life of the torque limiting coupling is increased considerably and also the precise complying with a preset release moment is ensured.

The rolls may, for instance, by guided in hollow cylindrical recesses which are formed on the face sides of one of the coupling parts.

However, preferably the rolls are received rotatably on shafts supported by the first coupling part.

Such a guidance of a roll provides for low friction and thereby low wear of the roll. The bearing provided on one shaft may for instance be designed as a needle bearing allowing for high loading while still being of a space-saving design and ensuring low friction.

According to a preferred development of this design, the axes of rotation of the rolls determined by the shafts are arranged at a distance from the longitudinal axis of the first coupling part.

Thus, the axis of rotation of the roll does not extend through the longitudinal axis or axis of rotation of the first coupling part, but extends at an angle thereto. Thus, the direction of rotation of the roll is not in tangential direction, but is fixed at an angle with respect to the tangent. Thus, in one of both possible directions of rotation, which is preferably the working direction for tightening of screws, the rolls move in a self-centering way. Thereby, the rolls do not displace to the outset while moving about themselves, and thus cannot work against any housing parts surrounding the roll.

According to a further development of this design, the rolls are supported in a floating manner on their shafts.

Thereby, the supporting of the rolls on the shafts is simplified and also saves space, since fixation parts become superfluous.

According to a further development of this design, the shortest distance between the axis of rotation of each roll and the longitudinal axis of the first coupling part is between 5% and 15%, preferably between 9% and 11% of the distance between the center of the roll and the longitudinal axis.

It has been found that with such a design particularly good self-centering properties can be reached.

According to still another embodiment of the invention, a cam guide way extending circumferentially is provided on one of the coupling parts and is formed by several guide sections, preferably by three guide sections, all being of equal design.

Thereby, the release character of the torque limiting coupling can be influenced by the particular design of the cam guide way in a simple way. Also it is preferred, when each guide section comprises a cam, the flanks of which forming a leading side and a trailing side for a roll, which both may have different slopes.

Needless to say, the features mentioned before and to be explained hereinafter, cannot be utilized in the given combination, but also in different combinations or on its own, without leaving the scope of the invention. Further advantages and features of the invention may be taken from the following description of a preferred embodiment of the invention with reference to the enclosed drawings.

DETAILED DESCRIPTION OF THE PREFERRED EMBODIMENT

Figure 1:
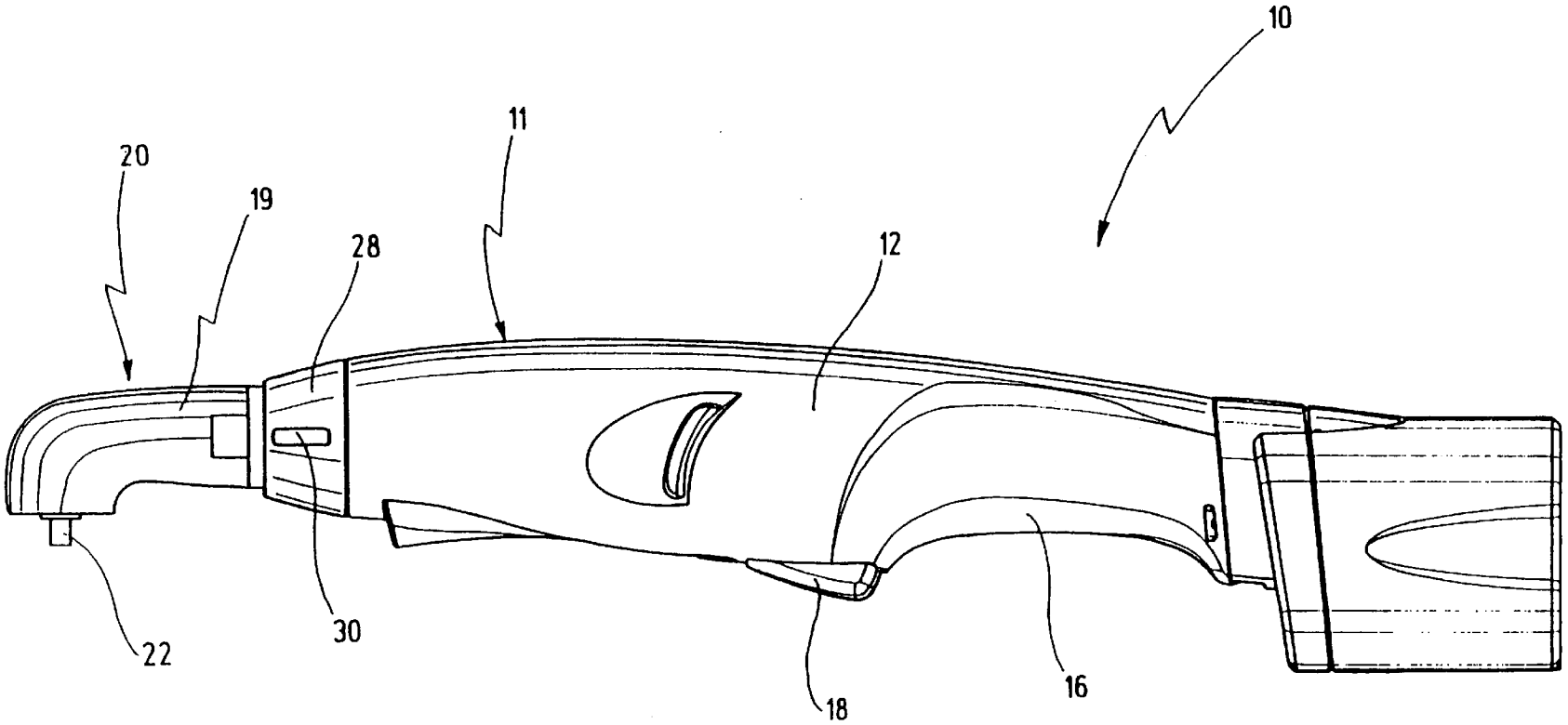
FIG. 1 shows a side view of a screwdriver according to the invention.

In FIG. 1, a screwdriver according to the invention is shown in side view and depicted in total with reference numeral 10. The screwdriver 10 comprises a housing 11 having a main housing part 12 on which a grip section 16 is formed. When holding the screwdriver at the grip section 16, a main switch 18 can easily be reached. At the front end of the main housing part 12, an angle head housing 19 of an angle head 12 is fixed. From the angle head 20 a tool receptacle 22 protrudes at a right angle to a longitudinal axis of the screwdriver 10. Such a screwdriver, when compared with a regular power screwdriver of straight design, has the advantage that the reaction torque absorbed by the screwdriver when tightening a screw does not lead to a rotation of the screwdriver about its longitudinal axis, but to a pivot movement of the screwdriver about the axis defined by the tool receptacle 22 arranged at a right angle to the longitudinal axis of the screwdriver. Such pivot movements can be absorbed by a worker much easier than a rotation of the screwdriver about its longitudinal axis.

At a transition between the angle head housing 19 and the main housing part 12, a rotation ring 28 is arranged rotatably with respect to the main housing part 12. A tool may be inserted through slots 30 (in FIG. 1 only one can be seen) for adjusting the release torque of the screwdriver 10, as will be explained hereinafter.

Figure 2:
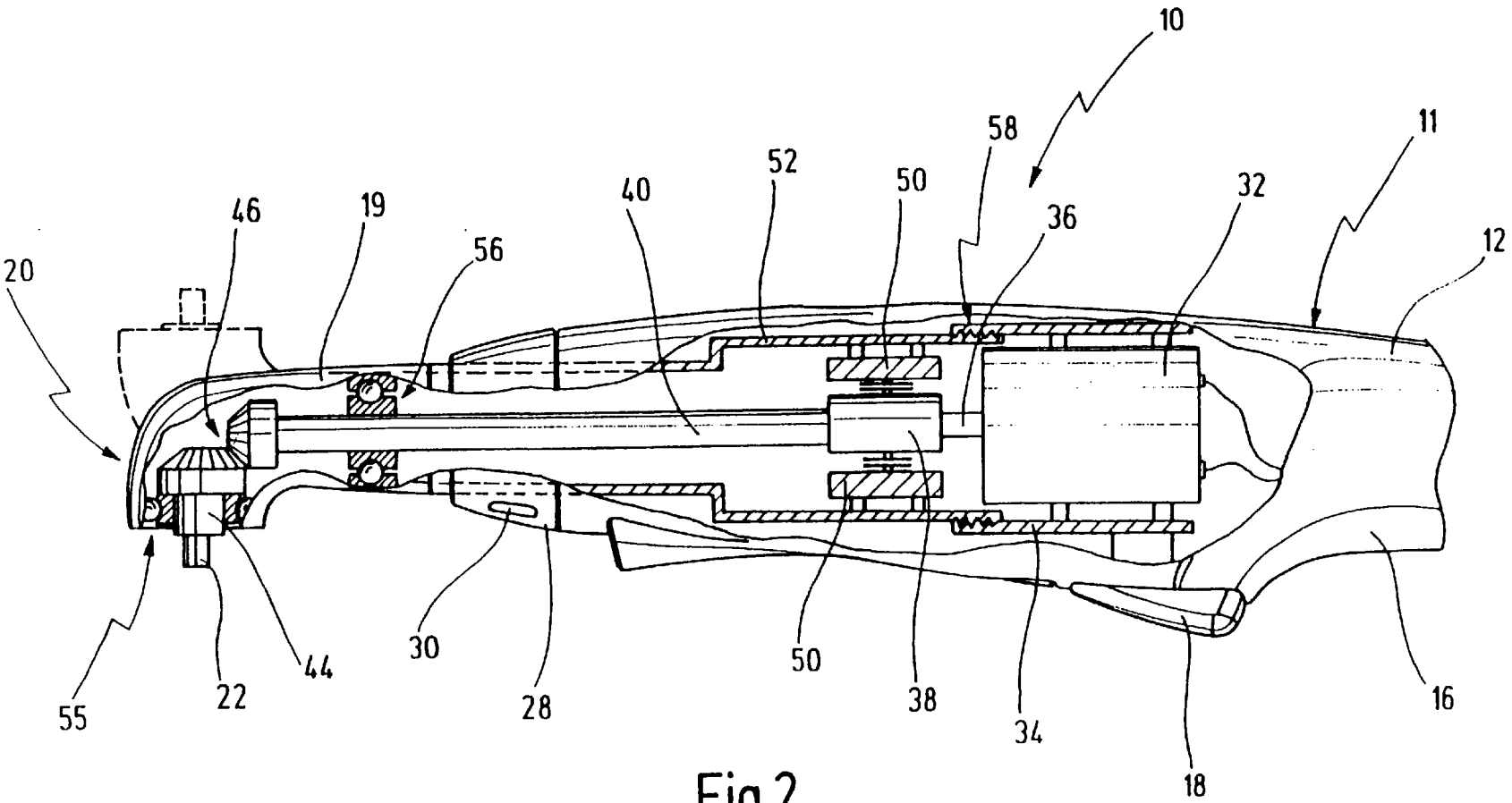
FIG. 2 shows a front part of the screwdriver shown in FIG. 1, wherein the inner parts of the screwdriver within a housing section are shown schematically.

FIG. 2 shows a part of a screwdriver 10 of FIG. 1, with the housing parts partially broken away. The parts of the screwdriver 10 that can be seen are only depicted schematically. The screwdriver 10 comprises a drive 32 that may be configured as an electric motor which is secured fixedly against rotation to a supporting sleeve 34, the latter being secured on the main housing part 12.

The drive 32 via an intermediate shaft 36 drives a reduction gear which may be configured as a planetary gear 38, the output side of which rotates a drive spindle 40. The drive spindle 40 via a conical gear wheel 46 drives a tool spindle 44 which carries a tool receptacle 22 at its free end.

In addition, in FIG. 2 a torque limiting coupling 50 is shown schematically which couples a reaction part of the planetary gear 38 to an adjusting sleeve 52, the reaction part being defined as the part of the planetary gear absorbing any reaction moment between the spindle 40 and the planetary gear 38. The adjusting sleeve 52 is configured integral with an angle head housing 19 or may be connected therewith via one or more intermediate parts in a way fixedly against rotation. For rotating angle head 20, for instance into the position shown in FIG. 2 in dashed lines, the complete angle head 20, i.e. the angle head housing 19 with bearings 55 and 56 for the spindles 40 and 44 received therein, as well as the adjusting sleeve 52, is rotated with respect to the supporting sleeve 34. To allow a rotation of the angle head 20, an adjustment device 58 which, in the case shown, may be designed simply as a screw connection, is provided between the supporting sleeve 34 and the adjusting sleeve 52. When the torque limiting coupling 50 is engaged, then also the reaction part of the planetary gear 38 is held fixedly against rotation with respect to the angle head 20 and is coupled to the drive 32 via the adjustment device 58.

Such a connection of the planetary gear 38 to the angle head 20 by coupling the planetary gear 38 to the drive 32 via the adjustment device 58 leads to considerable advantages when compared to a prior art design in which the gear between the drive and the shaft would be fixed to the main housing part, and the adjustment device would connect the output side of the gear with the spindle driving the angle head.

For ease of understanding, it may be supposed that the spindle 40 is blocked by a tightened screw, so that the full torque exerted by drive 32 must be absorbed by the housing parts of the angle type screwdriver 10. The intermediate shaft 36 is then subjected to the torque produced by drive 32 and acting between drive 32 and the planetary gear 38. A respective counter torque of even amount is received by the housing parts, namely by the supporting sleeve 34 and the adjusting sleeve 52, if the torque limiting coupling 50 is engaged. This torque is smaller than the torque acting between the planetary gear 38 and the angle head housing 19, namely is reduced by the reducing factor of the planetary gear. Therefore, the adjusting device 58 may be designed as a simple screw connection which may have in addition a locking mechanism, if desired. However, such a locking mechanism is not necessary, just for torque transmission. However, in case such a locking mechanism, which is known per se, is desired, it can be made very simple and light, since it must absorb only a small torque.

The same considerations also apply to screwdrivers having a gear, the reaction part of which is not connected via the torque limiting coupling 50, but directly to the adjustment sleeve or to a different part that is supported by the angle head fixedly against rotation. Also screwdrivers of straight design instead of angle-type screwdrivers will have the advantages of the invention explained before.

Figure 3:
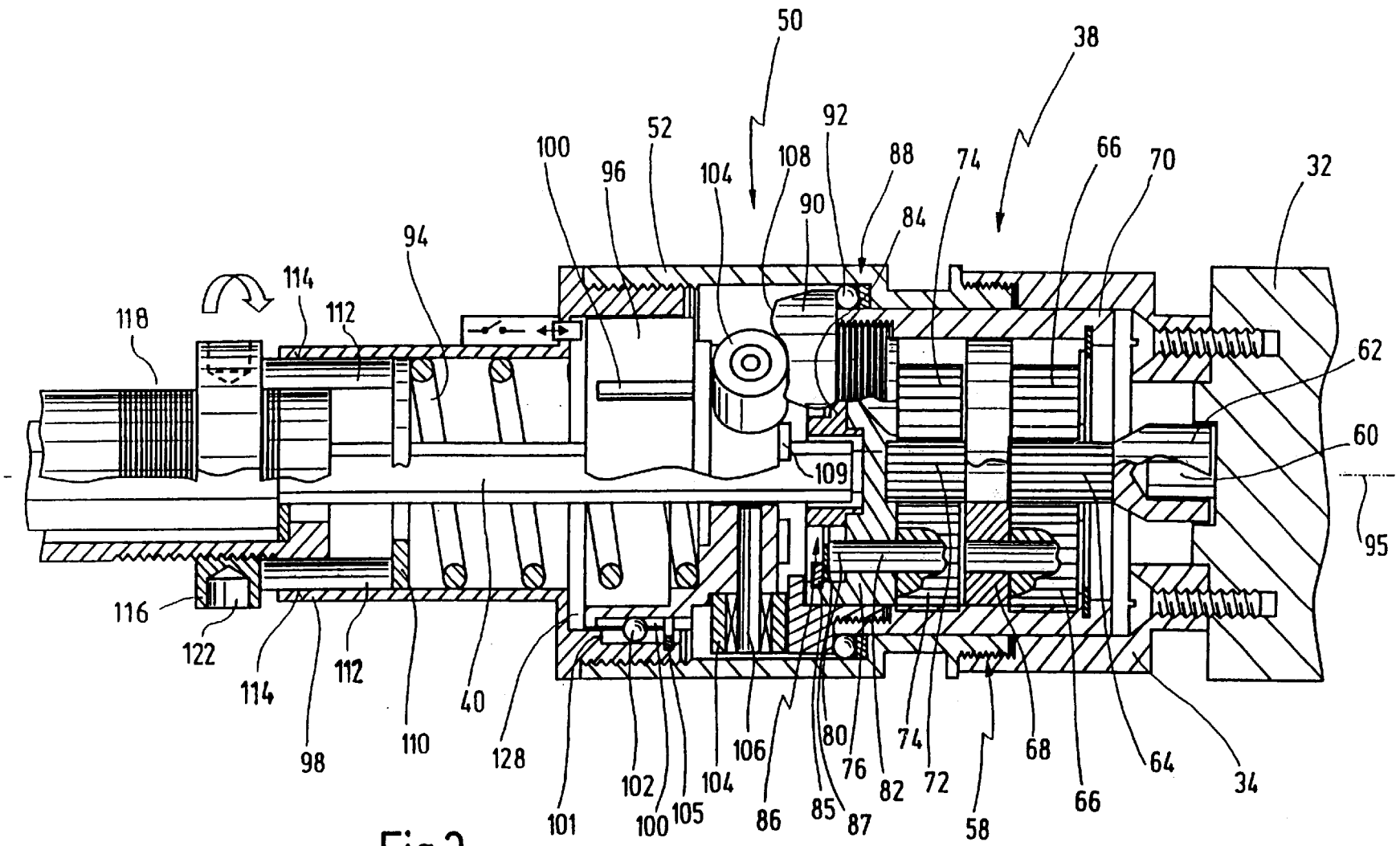
FIG. 3 shows an axial section through a section of a drive train of the screwdriver shown in FIGS. 1 and 2, in which a planetary gear and a torque limiting coupling can be seen partially sectioned.

In FIG. 3 particulars of the parts of the screwdriver shown in FIG. 2 only schematically are shown in axial section.

An intermediate shaft 62 is attached to a hexagonally formed driving stud 60 of the drive 32 shown only schematically in FIG. 3. The intermediate shaft 62 is integral with a first sun wheel 64 of the planetary gear 38 which is designed with two stages. The first sun wheel 64 engages with three first planetary wheels 66 of a first planetary gear stage, only two of which can be seen in FIG. 3. The first planetary wheels 66 are held rotatably on a first planetary wheel support 68 and also engage with a hollow wheel 70 which extends along the total length of the planetary gear 38. The first planetary wheel support 68 is configured integral with a second solar wheel 72 or may be connected for common rotation therewith, the second solar wheel 72 engaging with second planetary wheels 74. The second planetary wheels 74 are held rotatably on a second planetary wheel support 76 and also engage with the hollow wheel 70. Planetary wheel axes 82 on which the second planetary wheel 72 are guided, protrude through the second planetary wheel support 76 and form studs 80 on its side facing away from the planetary gear. These studs 80 engage with wings of a catch wheel 84 which drives the hexagonally formed drive spindle 40 and which rests in axial direction against a ring 87 supported by a retainer ring 85. The studs 80 and the catch wheel 84 together form the loose coupling 86.

The hollow wheel 70 which absorbs a reaction moment between intermediate shaft 62 and spindle 40 and thus is the reaction part of the planetary gear 38, is supported rotatably by a bearing 88 within the supporting sleeve 34 which is screw connected with drive 32, and thus is supported within adjusting sleeve 52 connected via the adjusting device 58. The hollow wheel 70 is connected to adjusting sleeve 52 (or with any part fixed for common rotation therewith) via the torque limiting coupling 50. The latter comprises a cam ring 90 which is screw-connected with hollow wheel 70 and which comprises a shoulder 92 protruding beyond the hollow wheel 70 that is also supported by the adjusting sleeve 52 via the bearing 88. The torque limiting coupling further comprises a ratchet ring 96 which is biased against cam ring 90 via a compression spring 94. The ratchet ring 96 is displaceable in axial direction, i.e. in longitudinal direction 95 of the drive spindle 40, however is fixed in an intermediate sleeve 98 that engages with the adjustment sleeve 52 for common rotation therewith. This arrangement of the ratchet ring 96, fixed against rotation, but axially displaceable, is effected by means of first and second longitudinal grooves 100, which extend in a circumferential face of the ratchet ring 96 and, on the inner side, along the intermediate sleeve 98 and which cooperate with guide balls 102. By means of the guide balls 102 which are guided along first and second longitudinal grooves 100 and 101, respectively, the ratchet ring 96 and the intermediate sleeve 98 can be axially displaced, while a retainer ring 105 received in the intermediate sleeve 98 prevents the guide balls 102 from falling out.

Three rolls 104 are held rotatably on axes 106 on the side of the ratchet ring 96 facing the cam ring 90. The rolls 104 can roll along a cam guide way 108 which is formed on a face side of cam ring 90 facing the ratchet ring 96. In addition, on the face side of ratchet ring 96 facing the cam ring 90, three protrusions 109 are formed, the function of which will be explained with reference to FIGS. 5 through 10 in more detail.

At the rear side, the compression spring 94 rests against a tension plate 110 which is received within intermediate sleeve 98 axially displaceable. Four tension studs 112 that are equally dispersed circumferentially and are guided in axial bores 114 that are formed in a shoulder of intermediate sleeve 98 and that rest against a adjusting ring 116 act onto the tension plate 110. The adjusting ring 116 can be displaced in longitudinal direction 95 by rotating same within a threaded section 118 formed on the outer side of intermediate sleeve 98. A displacement of adjustment ring 116 in longitudinal direction along threaded section 118 of intermediate sleeve 98 is transmitted via the tension studs 112 and the tension plate 110 onto the pressure spring 94, so that in this way, the bias force between ratchet ring 96 and cam ring 90 can be adjusted. For actuating the adjusting ring 116, a tool, for instance a screwdriver, is inserted through one of the slots 30 formed on rotation ring 28 (see FIG. 1) into one of the plug-in sockets 122 formed on the adjusting ring 116. Then the adjusting ring 116 together with rotating ring 28 can be rotated so far that the desired bias force of pressure spring 94 and thereby the release torque of the torque limiting coupling 50 is set.

During tightening of a screw, the rolls 104 rest against the cams formed on cam guide way 108 so that the reaction torque exerted onto hollow wheel 70 is transmitted via the cams, the rolls 104 and the ratchet ring 96 onto intermediate sleeve 98 and thereby onto the adjusting sleeve 52 connected thereto. Thus, the hollow wheel 70 rests when a screw is tightened. When the torque increases, then the torque acting on cam ring 90 increases so far that finally the cam ring 90 starts to rotate, and thereby to lift the rolls 104 via its cams, and thus the ratchet ring 96 against the force of pressure spring 94. When the cam ring is further rotated, then the cam ring will pass with its cams below the rolls 104, so that the rolls 104 will finally lower again under the pressure of pressure spring 94.

During rotation of the cam ring 90 of hollow wheel 70 connected therewith, the planetary gear 98 is not held any more fixedly against rotation, so that the torque exerted by drive 32 onto spindle 40 is essentially reduced to zero. When the ratchet ring 96 is lifted against the force of pressure spring 94, the ratchet ring 96 will trigger a switch 124, which protrudes through intermediate sleeve 98 into a free space 128 formed above ratchet ring 96. The switch 124 will interrupt the power supply for drive 32 and thus will ensure that, after the release torque of cam ring 90 has been exceeded, will not rotate below ratchet ring 96 several times.

Before further details with respect to torque limiting coupling 50 will be explained, in the following the loose coupling 86 provided on the screwdriver between the planetary gear 38 and the drive spindle 40 shall be described with reference to FIG. 4.

Figure 4:
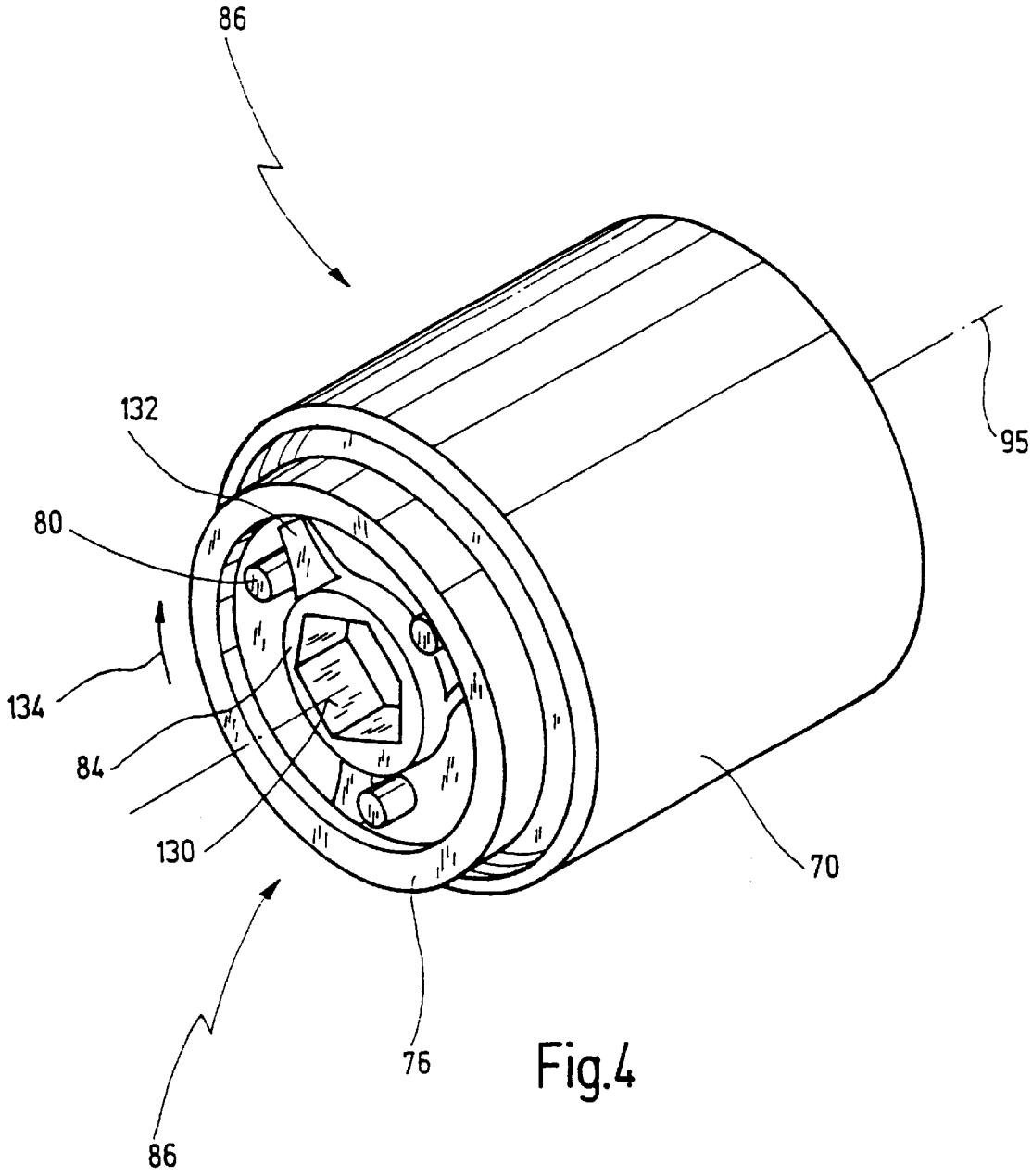
FIG. 4 is a perspective view of the loose coupling, which is shown in FIGS. 1 to 3.

In FIG. 4, the loose coupling 86 between the output side of planetary gear 38 and spindle 40 is depicted in perspective view. The loose coupling comprises three studs 80 that are formed by the planetary wheel shafts 82 that protrude through the second planetary wheel support 76. Further, the loose coupling comprises a catch wheel 84 that is guided rotatably in a central recess of the second planetary wheel support 76. The catch wheel 84 comprises a central, hexagonally formed passage 130 into which an end of drive spindle 40, which also has a hexagonal cross-section is inserted, when mounted. Three wings 132 extend from the center of the catch wheel 84 radially to the outside, namely so far as to enable an engaging with the studs 80. When a screw is tightened, the studs 80 will rotate together with the second planetary wheel support 76 that supports the studs about the longitudinal axis 95 of the spindle 40, and thus will engage with the wings 132 of catch wheel 84. In this way, the spindle 40 guided on catch wheel 84 is coupled to the output side of planetary gear 38.

When the torque limiting coupling 50 releases upon reaching the release torque, then the force exerted by pressure spring 94 will effect that the studs 80 reverse their direction of rotation. During this movement denoted by arrow 134, the studs 80 do not engage with the wings 132 of catch wheel 84 so that no torque is transmitted onto drive spindle 40. Since the movement of studs 80 caused by the torque limiting coupling 50 is only short, the studs will remain in an intermediate position between wings 132. Therefore, the loose coupling 86 will couple after a short time lag during a subsequent screwing operation.

Figure 5:
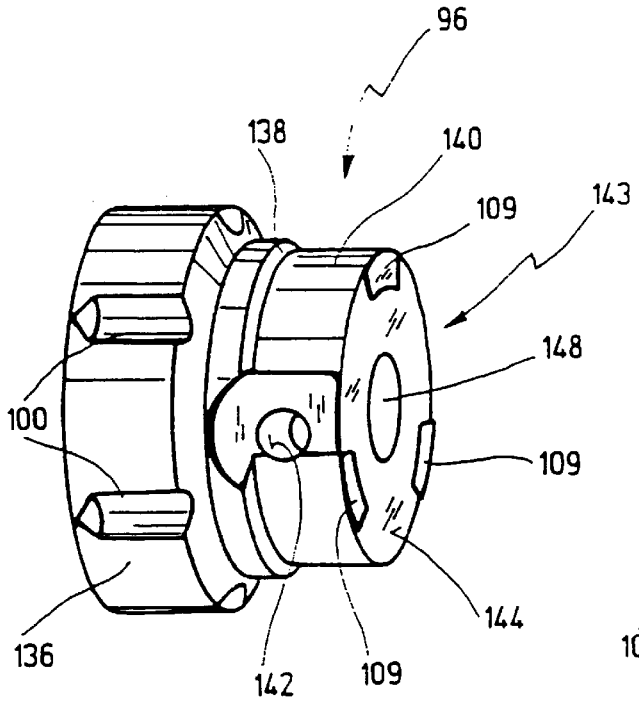
FIG. 5 shows a perspective view of a ratchet ring of the torque limiting coupling according to FIG. 3.

FIG. 5 shows the ratchet ring 96 in a perspective view. The ratchet ring 96 is divided into three sections 136, 138 and 140 of different diameters. The longitudinal grooves 100 are distributed in equal angular intervals along the circumference of the first section 136 having the largest diameter. The ratchet ring 96 is held by these longitudinal grooves 100 displaceably in axial direction and secured against rotation by means of the guide balls 102 to the intermediate sleeve 98. The first section 136 is followed by a second section 138 and thereafter by the third section 140. This third section 140 comprises three circumferential bores 142 which act to receive the shafts 106 (in FIG. 5, only one bore 142 facing the viewer can be seen). The region surrounding the end of the bores 142 of the second section 138 and of the third section 140 is milled in a flat way to provide a rest surface for the rolls 104. On the face side 143 of ratchet ring 96, when mounted on cam ring 90, a flat front surface 144 is provided that forms a slide face of the ratchet ring 96. From the front surface 144, three protrusions 109 protrude that also form slide surfaces of ratchet ring 96. A central bore 148 extends completely through the ratchet ring 96, the drive spindle 40 extending freely rotatable into the bore 148, when mounted.

Figure 6:
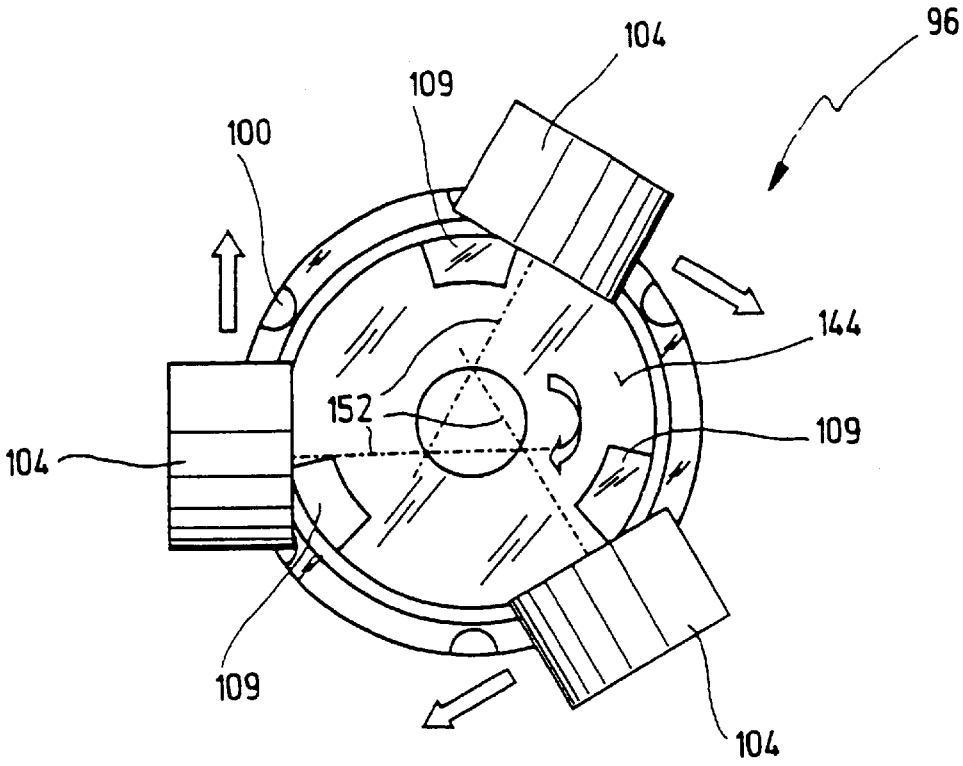
FIG. 6 shows a top view of the ratchet ring according to FIG. 5, wherein rolls received on the ratchet ring are shown in addition.

In FIG. 6, a top view of the front side 143 of ratchet ring 96 shown in FIG. 5 is depicted. In this representation, also the rolls 104 received on the ratchet ring 96 are shown. In addition, in the top view from FIG. 6, the longitudinal grooves 100 as well as the protrusions 109 can be seen. Depicted in dashed lines are the locations of the axes 106 given by the rotating axes 152 of the rolls 104. As can easily be seen in FIG. 6, the rotation axes 152 are located at a distance from the longitudinal axis of ratchet ring 96 which is perpendicular to the front surface 144. Therefore, the rotating axes 152 do not intersect in a common point on this longitudinal axis. By contrast, they are each offset with respect to a radius linking the circumference and the longitudinal axis.

The effect of this offset of the rotating axes 152 will now be explained with reference to the schematic representation of FIG. 7. The longitudinal axis 154 of ratchet ring 96 is depicted by a cross. Between the axis of rotation 152 shown in full lines in FIG. 7 and the longitudinal axis 154, a space 156 which is depicted by two arrows remains. The space may be between 5% and 15%, preferably between 9% and 11% of the distance between the center 158 of a roll rotating about the axis of rotation 152 and the longitudinal axis 154. The running direction 160 of a roll extending perpendicularly to the axis of rotation 152 is depicted by an arrow.

Figure 7:
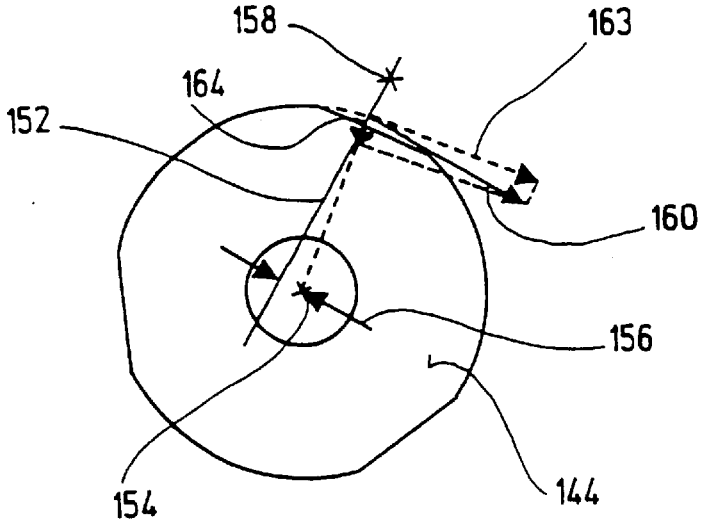
FIG. 7 is a schematic representation of the arrangement of the axes on which the rolls of the ratchet ring shown in FIG. 6 are held rotatably.

Shown in FIG. 7 in dashed lines is a division of the running direction 160 by vectors into a tangential component of movement 163 and a radial component of movement 164 extending radially to the center side. The tangential component of movement 163 corresponds to the running direction of a roll, the axis of which is not spaced from the longitudinal axis 154, but extends therethrough. With such a running direction, there would be no radial component of movement.

However, according to the inventive design, the distance 156 between the axis of rotation 152 and between the longitudinal axis 154, and thus also the radial component of movement 164, is different from zero, which leads to a self-centering of the rolls 104. The radial component of movement 164 directed to the inner side thus, in other words, effects that the rolls 104 cannot move to the outside or can only move to a small extent in radial direction, when the cam ring 90 moves below the rolls 104. Consequently, the rolls 104 cannot dig into the support sleeve 34 surrounding same. Therefore, the rolls 104 can be supported floatingly on the axes 106 without any additional means of fixation. At the same time, any wear of the rolls 104 and the surrounding support sleeve 34 is decreased and a save function is ensured, since any problems caused by friction are avoided.

Figure 8:
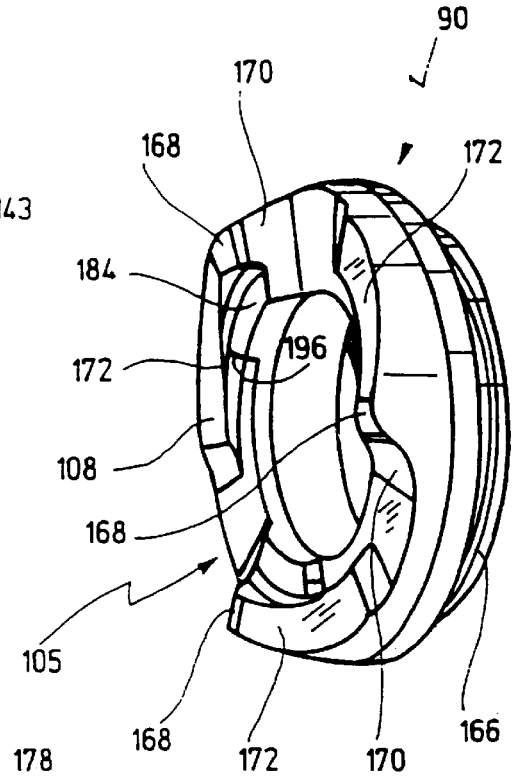
FIG. 8 shows a perspective view of a cam ring of the torque limiting coupling shown in FIG. 3.
Figure 9:
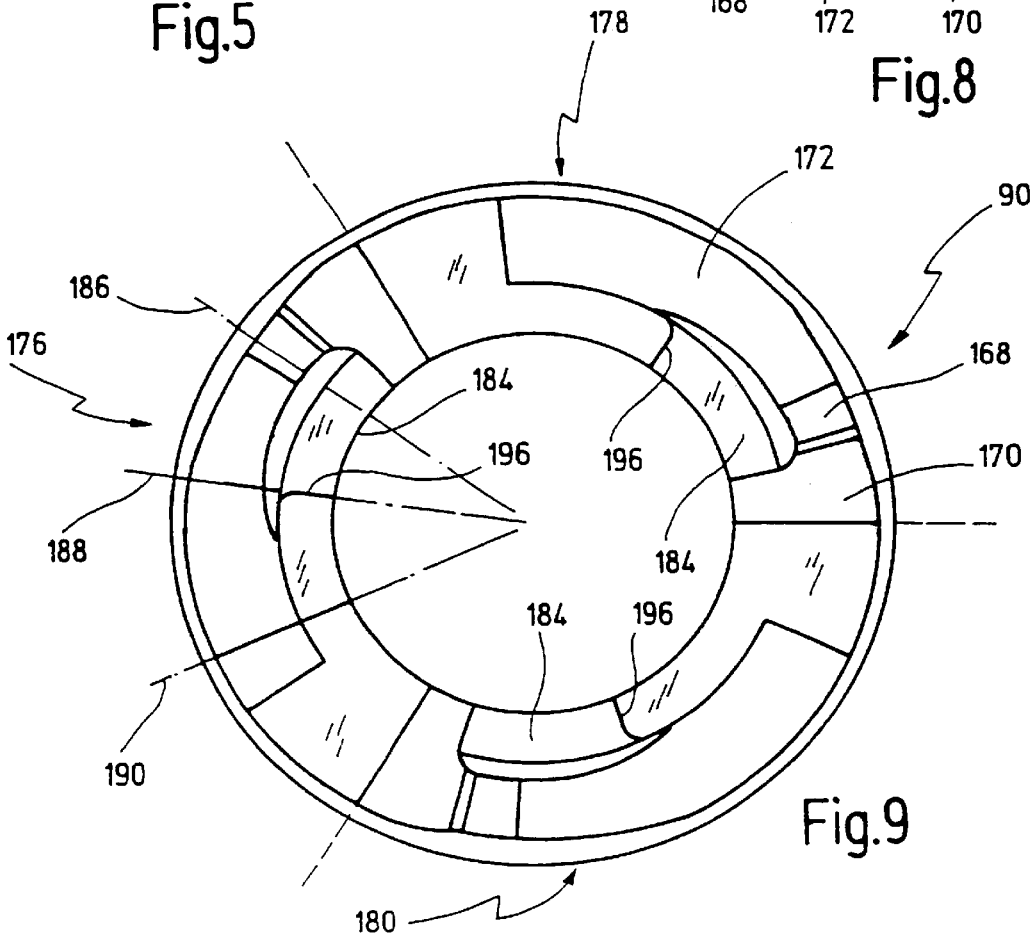
FIG. 9 shows a top view of the cam ring shown in FIG. 8.

In FIGS. 8 and 9, the cam ring 90 is shown in a perspective view and in a top view onto a face side 165 pointing toward the ratchet ring 96 when mounted, respectively. First of all, in FIG. 8, circumferential threads 166 can be seen for screwing the cam ring 90 into the hollow wheel 70. On the cam guide way 108 arranged at the outside, three cams 168 are formed, each having a steeper leading side 170 and a flatter trailing side 172. The cam guide way 108 is thus formed by three guide sections of equal configuration, transitions of which are, naturally, determined arbitrarily, due to the periodic configuration. In FIG. 9, these transitions are defined so as to coincide with the ends of the leading sides 170 facing away from the cams 168, thereby forming a first, a second and a third guide way section 176, 178 and 180, respectively.

The cam guide way 108 comprises three steps 184 arranged at a distance from each other, which are limited on one side by shoulders 196 and on the other side by the leading sides 170 of the cams 168, which extend about the complete ring width in this region. Herein, the steps 184 provide slide faces of the cam ring 90 extending in a radial plane, against which the ratchet ring 96 can rest with its front surface 144 or with its protrusions 109 and can slide therealong. The shoulders 196 further act as catches against which the protrusions 109 can run during a relative rotation between cam ring 90 and ratchet ring 96, when the front surface 144 stops on the steps 184. This way, a locking action between cam ring 90 and ratchet ring 96 is effected, thus preventing a further relative movement in this direction of rotation.

In the following, the course of events occurring between the cam ring 90 and the ratchet ring 96 during tightening and untightening of screws will be explained with reference to FIGS. 10*a*–10*h*.

Herein, on the lower side, a layout extending roughly across two guide sections of the cam ring 90 is shown. Herein, the full line corresponds to a contour of the cam guide way 108, while the dashed line corresponds to the contour of the steps 184, which are separated, respectively, by lowered sections 192. To facilitate a comparison with the top view of FIG. 9, in both figures, always three reference lines 186, 188 and 190 are shown. The reference line 186 depicts the apex points of the cams 168, and the reference line 188 depicts the shoulders 196. The end of the leading sides 172 is denoted by the reference line 190, followed by the lowered sections 192, which transition into the respective leading sides 170 of the cams following thereafter. In addition, in FIGS. 10*a*–10*h*, a partial view of the ratchet ring 96 is shown. Also one of the rolls 104, as well as one of the protrusions 109 below the front surface 144 can be seen. Since the arrangement of the rolls 104 and the protrusions 109 repeats periodically in equal configuration like the contour of the cam guide way 108, the ratchet ring 96 is shown only with one of the rolls 104 and one of the protrusions 109. Also, in FIGS. 10*a*–10*h*, the relative movement between ratchet ring 96 and cam guide way 108 for ease of explanation is shown, as if ratchet ring 96 would move beyond the fixed cam guide way 108. However, in reality, the cam ring 90 will move below the ratchet ring 96 as already explained above. Therefore, in the following, it is said that the rolls 104 moves above the cams 168, when, in reality, this shall define that the cams 168 move below the rolls 104.

Figures 10A, 10B, 10C, 10D:
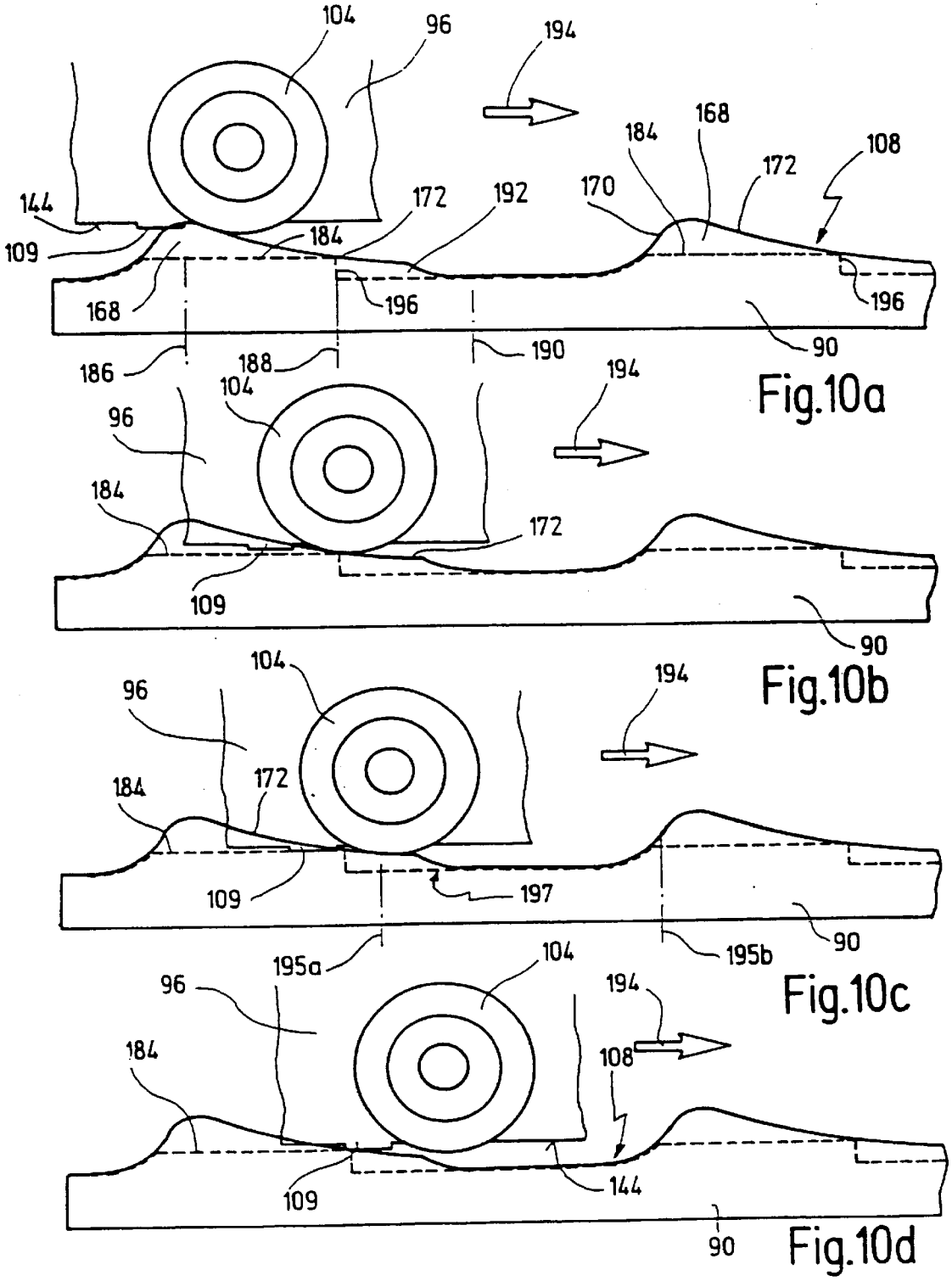
FIGS. 10*a–h* each show a section of an involute of the cam ring of FIGS. 8 and 9, shown in different relative positions between the cam ring and the ratchet ring.

FIG. 10*a* shows a respective arrangement of the cam ring 90 and the ratchet ring 96 at a time when the torque limiting coupling 50 was just released so that the rolls 104 have already rolled past the cams 168. Herein, the rolls 104 rest on the trailing sides 172 of the cams 168, while the front surface 144 as well as the protrusions 109 move at a distance from the subjacent steps 184 above the cam ring 90.

After a further movement (see FIG. 10*b*) into the direction of an arrow 194, the rolls 104 roll on the trailing sides 172, while the ratchet ring 96 approaches the cam ring 90. The protrusions 109 also make this movement, until they finally slide with their front faces onto the steps 184, as shown in FIG. 10*c*. At this time, the rolls 104 are relieved, this relieve action occurring quasi-continuously, due to the relatively small slope of the trailing sides 172. In FIG. 10*c*, two further reference lines 195*a* and 195*b* limit a partial section 197 of the cam guide way 108 which at no time is touched by the rolls 104. The ratchet ring 96 then only rests with its front face 144 or its protrusions 109 against the steps 184 of the cam ring 90.

Figure 10E:
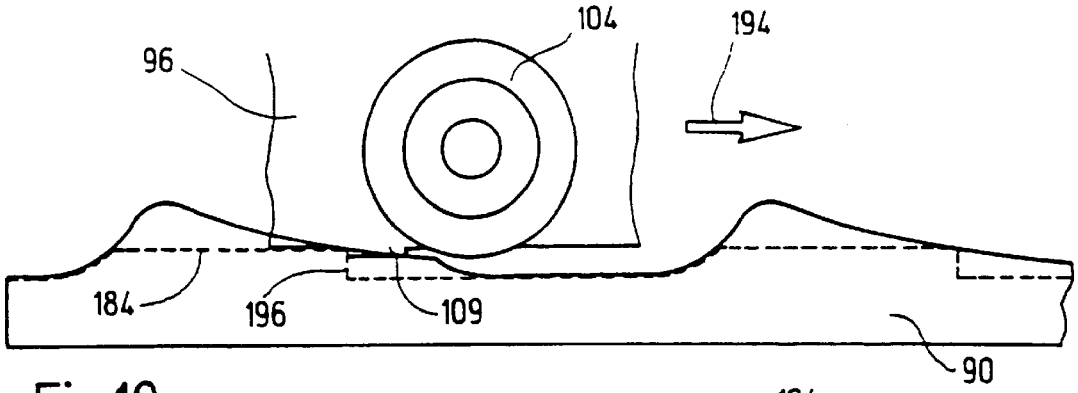
Figure 10F:
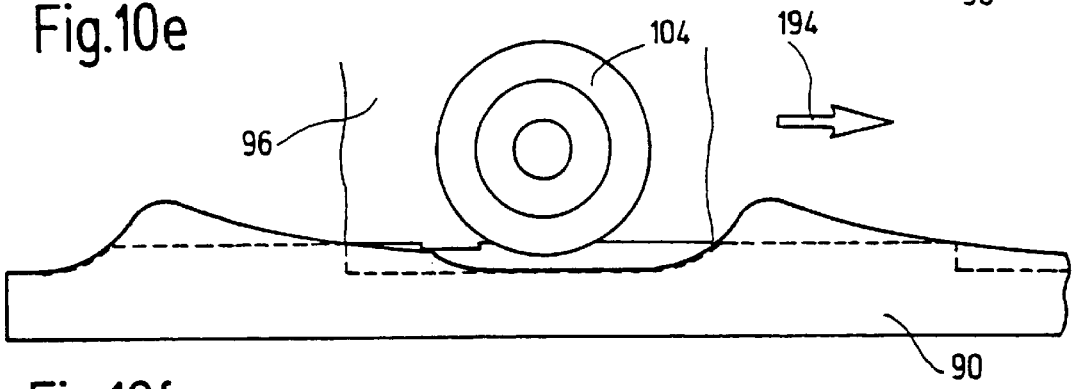

It can be seen in FIG. 10*d*, that the rolls 104 have already cleared from the cam guide way 108 so that the ratchet ring 96 only rests with its protrusions 109 against the steps 184 of the cam ring 90. When continuing the movement into the direction of the arrow 194, the protrusions 109 slide beyond the transition between the steps 184 and the shoulders 196 forming the lowered sections 192, whereby the ratchet ring 96 is lowered at a small amount with respect to the cam ring 90 so that now, the ratchet ring 96 rests on the cam ring 90 with its front surface 144 against the steps 184 (FIG. 10*e*).

Figure 10G:
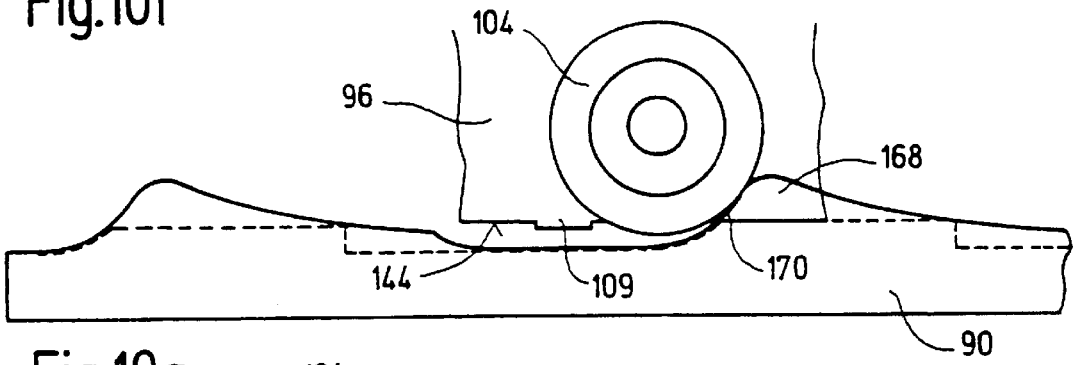

This state is maintained also during further forward movement (FIG. 10*f*), until the rolls 104 finally run against the leading sides 170 of the respective subsequent cams 168 and are ready for tightening another screw (FIG. 10*g*). Namely, at this moment, the torque limiting coupling 50 is engaged again, since now a torque transmission between the cam ring 90 and the ratchet ring 96 can be effected via the rolls 104 along the leading sides 170. While the rolls 104 rest against the leading sides 170 of cams 168 for transmitting a torque between the cam ring 90 and the ratchet ring 96 when tightening a screw, the ratchet ring 96 rests via its front face 144 in axial direction against steps 184. Thereby, a double loading of the rolls 104 by the pressure force exerted by the pressure spring 94 and by the torque exerted by drive 32 is avoided.

When the torque limiting coupling 50 disengages, the ratchet ring 96 is displaced in axial direction so far that the switch 124 is actuated and thus, drive 32 of the screwdriver 10 is shut off. Thus, at the time at which the rolls 104 run again against the leading sides 170, the drive 32 is already without power, so that there remains no significant torque between the cam ring 90 and the ratchet ring 96, until the drive 32 is again switched on by the operator.

Figure 10H:
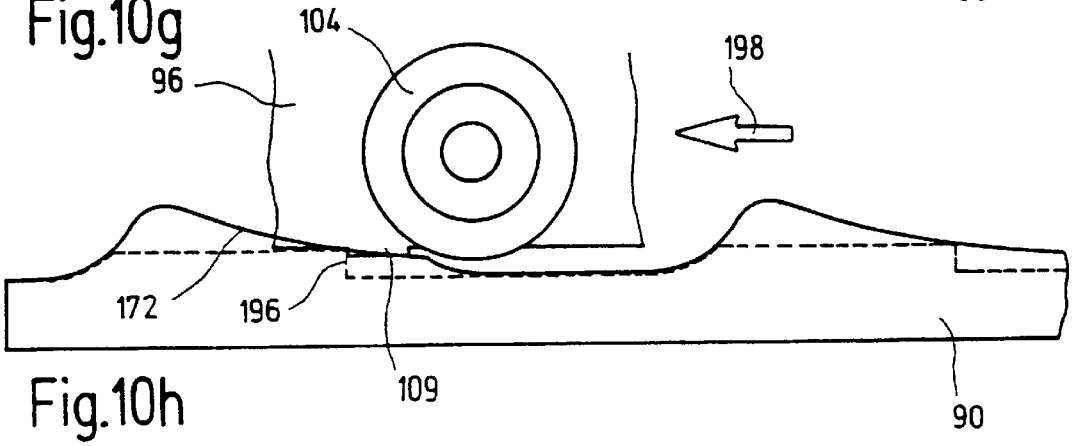

If the operator now does not desire to tighten another screw, but causes a change of the direction of rotation of the screwdriver 10, then a reversed relative movement between the cam ring 90 and the ratchet ring 96, shown in FIG. 10*h* by an arrow 198, is effected. Thereafter, the ratchet ring 96 moves back again, while still resting with its front surface 144 on the steps 184. However, before the rolls 104 again run against the trailing sides 172, the protrusions 109 engage with the shoulders 196, whereby the locking between the cam ring 90 and the ratchet ring 96 is effected, as already described above.

Due to this locking state, now torque can be transmitted between the drive 32 and the spindle 40. This torque may be considerably higher than the torque that can be transmitted between the rolls 104 and the leading sides 170 of the cams 168. In this way, the release characteristic is designed asymmetrically.

The locking between the protrusions 109 and the shoulders 196 leads to a considerable reduction in friction wear between the parts of the torque limiting coupling 50, since the higher torques necessary for unscrewing screws must not be borne by the rolls 104. Since the protrusions 109 rest against the shoulders 196 in a two-dimensional way, also at higher torques, there are no peak point loads that could cause a deformation or any considerable wear of the parts co-acting with each other.

What is claimed is:

1. A power screwdriver comprising:

a housing having a main housing;

a drive received within said main housing, said drive having a first direction of rotation for tightening a screw and a second direction of rotation for loosening a screw;

an angle head;

a tool spindle received within said angle head and having a tool receptacle for driving a tool;

a drive shaft for driving said tool spindle, said drive shaft being arranged at an angle to said tool spindle;

an angle head housing enclosing said angle head;

a torque limiting coupling having a predetermined release torque and having first and second coupling parts;

a spring for axially biasing said first coupling part against said second coupling part;

a plurality of roll bodies rolling between said first and second coupling parts and coupling said first and second coupling parts when driving the screwdriver in a first direction of rotation until said predetermined release torque is reached;

first catches provided on said first coupling part;

second catches provided on said second coupling part, said first and second catches coacting with each other for locking both coupling parts directly when driven in said second direction of rotation;

a reduction gear received within said main housing, said reduction gear being configured as a planetary gear having an input end driven by said drive, having an output end driving said drive shaft, and having a hollow wheel within which at least one sun wheel and a plurality of planetary wheels engaging said hollow wheel are received, the latter acting as a reaction part receiving any reaction moment between said input end and said output end;

an adjusting device having a first adjusting part connected to said angle head, and having a second adjusting part connected to said main housing, said first and second adjusting parts being arranged rotatably relative to each other, thereby allowing angular adjustment of said angle head housing with respect to said main housing;

wherein said first coupling part of said torque limiting coupling is supported by said first adjusting part connected to said angle head housing; and wherein said hollow wheel of said planetary gear is supported by said second coupling part of said torque limiting coupling.

2. The power screwdriver of claim 1, wherein said planetary gear is a two-stage planetary gear.

3. A power screwdriver comprising:

a housing having a main housing;

a drive received within said main housing, said drive having a first direction of rotation for tightening a screw and a second direction of rotation for loosening a screw;

an angle head;

a tool spindle received within said angle head and having a tool receptacle for driving a tool;

a drive shaft for driving said tool spindle, said drive shaft being arranged at an angle to said tool spindle;

an angle head housing enclosing said angle head;

a torque limiting coupling having a predetermined release torque and having first and second coupling parts;

a spring for axially biasing said first coupling part against said second coupling part;

a plurality of roll bodies rolling between said first and second coupling parts and coupling said first and second coupling parts when driving the screwdriver in a first direction of rotation until said predetermined release torque is reached;

first catches provided on said first coupling part;

second catches provided on said second coupling part, said first and second catches coacting with each other for locking both coupling parts directly when driven in said second direction of rotation;

a reduction gear received within said main housing, said reduction gear having an input end driven by said drive, having an output end driving said drive shaft, and having a reaction part receiving any reaction moment between said input end and said output end resulting from said reduction gear;

an adjusting device having a first adjusting part connected to said angle head, and having a second adjusting part connected to said main housing, said first and second adjusting parts being arranged rotatably relative to each other, thereby allowing angular adjustment of said angle head housing with respect to said main housing;

wherein said first coupling part of said torque limiting coupling is supported by said first adjusting part connected to said angle head housing; and wherein said reaction part of said reduction gear is supported by said second coupling part of said torque limiting coupling.

4. The power screwdriver of claim 3, wherein said first coupling part is arranged slidable in axial direction of said first adjusting part but fixed against relative rotation thereto.

5. The power screwdriver of claim 3, wherein said reaction part of said reduction gear is arranged rotatable with respect to said housing.

6. The power screwdriver of claim 3, further comprising a switch for switching off the screwdriver, said switch being actuable by said first coupling part when said torque limiting clutch releases.

7. The power screwdriver of claim 6, wherein said switch is actuable by an axial movement of said first coupling part.

8. The power screwdriver of claim 3, wherein said catches are configured for releasing the locking between each other when switching the direction of rotation.

9. The power screwdriver of claim 3, further comprising first and second slide faces provided on front faces of said first and second coupling parts facing each other, said first and second catch elements being arranged on said first and second slide faces.

10. The power screwdriver of claim 9, wherein said first slide faces of said first coupling part comprise steps and shoulders limiting said steps, and wherein said second slide faces of said second coupling part comprise front faces and protrusions axially protruding from said front faces, said protrusions of said second coupling element being configured for stopping said shoulders when driven in the second direction of rotation.

11. The power screwdriver of claim 9, wherein said second coupling part comprises a cam guide way comprising a plurality of guide sections, said cam guide way facing said first coupling part and forming a continuous path extending circumferentially.

12. The power screwdriver of claim 11, wherein said cam guide way comprises three guide sections.

13. The power screwdriver of claim 11, wherein said cam guide way is arranged concentrically to said slide face of said second coupling part.

14. The power screwdriver of claim 11, wherein each guide section comprises a cam having two flanks, one flank forming a leading side, and one flank forming a trailing side, said leading sides and said trailing sides being arranged for cooperating with said roll bodies.

15. The power screwdriver of claim 14, wherein said leading sides are steeper than said trailing sides.

16. The power screwdriver of claim 15, wherein each trailing section has a slope that decreases with increasing distance from the leading section.

17. The power screwdriver of claim 11, wherein the cam guide way between each two consecutive cams comprises a partial section configured for keeping free form said roll bodies.

18. The power screwdriver of claim 3, further comprising a loose coupling having a play when reversing the direction of rotation, said loose coupling being arranged between said output end of said reduction gear and said drive shaft.

19. The power screwdriver of claim 18, wherein said loose coupling comprises a plurality of studs axially extending from said output end of said reduction gear, and further comprises a catch wheel connected to said drive shaft for common rotation therewith, said catch wheel having a plurality of wings extending between said studs of said driving part, each said wing having a play in circular direction between two adjacent studs.

20. The power screwdriver of claim 19, wherein said reduction gear is configured as a planetary gear having a hollow wheel being configured as the reaction part, a plurality of planetary wheels being arranged within said hollow wheel.

21. The power screwdriver of claim 20, wherein said studs are configured as planetary wheel shafts carrying planetary wheels and protruding through planetary wheel supports of said planetary gear.

22. The power screwdriver of claim 3, wherein said roll bodies are configured as rolls.

23. The power screwdriver of claim 22, wherein said rolls are received rotatably on shafts supported by the first coupling part.

24. The power screwdriver of claim 23, wherein said shafts supporting the rolls define the axes of rotation of the rolls, said axes of rotation being arranged at a distance from the longitudinal axis of the first coupling part.

25. The power screwdriver of claim 24, wherein said rolls are floatingly supported on said shafts.

26. A power screwdriver for tightening and loosening of screws comprising:

a housing;

a drive received within said housing, said drive having a first direction of rotation for tightening a screw and having a second direction of rotation for loosening a screw;

a drive shaft for driving a tool receptacle;

a torque limiting coupling for transmitting torque received from said drive to said drive shaft, said torque limiting coupling having a predetermined release torque;

wherein said torque limiting coupling comprises:

a first coupling part;

a second coupling part;

a spring for axially biasing said first coupling part against said second coupling part;

a plurality of roll bodies rolling between said first and second coupling parts, said roll bodies coupling said first and second coupling parts when driving the screwdriver in a first direction of rotation until said predetermined release torque is reached;

first catches provided on said first coupling part;

second catches provided on said second coupling part;

said first and second catches coacting with each other for locking both coupling parts directly when driven in said second direction of rotation.

27. The power screwdriver of claim 26, wherein said catches are configured for releasing the locking between each other when switching the direction of rotation.

28. The power screwdriver of claim 26, further comprising first and second slide faces provided on front faces of said first and second coupling parts facing each other, said first and second slide faces being configured for supporting said first and second coupling parts in predetermined angular positions with respect to each other when said first and second slide faces rest against each other.

29. The power screwdriver of claim 26, further comprising first and second slide faces provided on front faces of said first and second coupling parts facing each other, said first and second catch elements being arranged on said first and second slide faces.

30. The power screwdriver of claim 29, wherein said first slide faces of said first coupling part comprise steps and shoulders limiting said steps, and wherein said second slide faces of said second coupling part comprise front faces and protrusions axially protruding from said front faces, said protrusions of said second coupling element being configured for stopping said shoulders when driven in the second direction of rotation.

31. The power screwdriver of claim 29, wherein said second coupling part comprises a cam guide way comprising a plurality of guide sections, said cam guide way facing said first coupling part and forming a continuous path extending circumferentially.

32. The power screwdriver of claim 31, wherein said cam guide way comprises three guide sections.

33. The power screwdriver of claim 31, wherein said cam guide way is arranged concentrically to said slide face of said second coupling part.

34. The power screwdriver of claim 31, wherein each guide section comprises a cam having two flanks, one flank forming a leading side, and one flank forming a trailing side, said leading sides and said trailing sides being arranged for cooperating with said roll bodies.

35. The power screwdriver of claim 34, wherein said leading sides are steeper than said trailing sides.

36. The power screwdriver of claim 35, wherein each trailing section has a slope that decreases with increasing distance from the leading section.

37. The power screwdriver of claim 35, wherein between each two consecutive cams the cam guide way comprises a partial section configured for keeping free form said roll bodies.

38. The power screwdriver of claim 37, wherein the slide faces are arranged with respect to the cam guide way such that the roll bodies are in contact with the leading sides of said cams and that the first coupling part simultaneously rests against the second coupling part in axial direction via the slide faces, when driven in the first direction of rotation while the torque limiting coupling is closed.

39. A power screwdriver comprising:

a housing having a main housing;

a drive received within said main housing;

an angle head;

a tool spindle received within said angle head and having a tool receptacle for driving a tool;

a drive shaft for driving said tool spindle arranged at an angle thereto;

an angle head housing enclosing said angle head;

a torque limiting coupling comprising first and second coupling parts releasing from each other when reaching a predetermined release torque;

a reduction gear received within said main housing, said reduction gear having an input end driven by said drive, having an output end driving said drive shaft, and having a reaction part receiving any reaction moment between said input end and said output end resulting from said reduction gear;

an adjusting device having a first adjusting part connected to said angle head, and having a second adjusting part connected to said main housing, said first and second adjusting parts being arranged rotatably relative to each other, thereby allowing angular adjustment of said angle head housing with respect to said main housing;

wherein said first coupling part of said torque limiting coupling is supported by said first adjusting part connected to said angle head housing; and wherein said reaction part of said reduction gear is supported by said second coupling part of said torque limiting coupling.

40. The power screwdriver of claim 39, wherein said reaction part is a hollow wheel of a planetary gear within which a sun wheel and several planetary wheels engaging said hollow wheel are received.

41. The power screwdriver of claim 40, wherein said planetary gear is a two-stage planetary gear.

42. The power screwdriver of claim 39, wherein said first coupling part is arranged slidable in axial direction of said first adjusting part but fixed against relative rotation thereto.

43. The power screwdriver of claim 39, wherein said reaction part of said reduction gear is arranged rotatable with respect to said housing.

44. The power screwdriver of claim 43, further comprising a switch for switching off the screwdriver, said switch being actuable by said first coupling part when said torque limiting clutch releases.

45. The power screwdriver of claim 44, wherein said switch is actuable by an axial movement of said first coupling part.

46. A power screwdriver for tightening and loosening of screws, comprising:

a drive having a first direction of rotation and a second direction of rotation;

a drive spindle for driving a tool receptacle;

a torque limiting coupling for transmitting torque from said drive to said drive spindle and for releasing when a predetermined release torque is reached; and a loose coupling for transmitting torque from said torque limiting coupling to said drive, said loose coupling having a play when reversing the direction of rotation.

47. The power screwdriver of claim 46, comprising a driving part comprising a plurality of axially extending studs, and further comprising a driven part being configured as a catch wheel having a plurality of wings extending between said studs of said driving part, each said wing having a play in circular direction between two adjacent studs.

* * * * *